US005601321A

United States Patent [19]

Simon

[11] Patent Number: 5,601,321

[45] Date of Patent: Feb. 11, 1997

[54] LITTER AND REFUSE RETRIEVAL DEVICE

[75] Inventor: Allen Simon, East Northport, N.Y.

[73] Assignee: Four Paws Products, Ltd., Hauppauge, N.Y.

[21] Appl. No.: 358,487

[22] Filed: Nov. 28, 1994

Related U.S. Application Data

[63] Continuation-in-part of Ser. No. 31,375, Nov. 23, 1994, Pat. No. Des. 368,003.

[51] Int. Cl.[6] ..... A01K 29/00; E01H 1/12

[52] U.S. Cl. ..... 294/1.4; 294/115

[58] Field of Search ..... 294/1.3–1.5, 19.1, 294/50.8, 55, 115, 100; 15/257.1, 257.6, 104.8

[56] References Cited

U.S. PATENT DOCUMENTS

| | | | |
|---|---|---|---|
| 652,077 | 6/1900 | Burson | 294/50.8 |
| 4,005,897 | 2/1977 | Smith | 294/115 |
| 4,247,139 | 1/1981 | Grieb | 294/1.4 |
| 4,248,468 | 2/1981 | Hastings | 294/115 |
| 4,477,111 | 10/1984 | Crooks | 294/1.4 |
| 4,951,987 | 8/1990 | Lebeau | 294/50.8 |
| 5,056,842 | 10/1991 | Lindenberg et al. | 294/1.4 |

FOREIGN PATENT DOCUMENTS

| | | | |
|---|---|---|---|
| 2095156 | 9/1982 | United Kingdom | 294/1.4 |

*Primary Examiner*—Dean Kramer
*Attorney, Agent, or Firm*—Darby & Darby

[57] ABSTRACT

A litter and refuse retrieval device for sanitarily and single-handedly cleaning up after a pet. The device includes an outer frame having a handle at one end and outer nipples at the other end for pivotally mounting two scoops. Each scoop includes extended disk portions with holes therethrough that overlap with the disk portions of the other scoop placing the holes in alignment for insertion of the outer nipples of the outer frame. An inner control frame is carried by the outer frame and includes linkage arms having outwardly extending cylindrical portions having nipples extending therefrom for pivotally mounting the two scoops adjacent to the outer nipples. In operation, the inner control frame is squeezed by the user toward a stop potion of the outer frame, causing the scoops to pivot in opposite directions. Also provided is a spring biasing mechanism for closing the scoops after the user has released the inner control frame.

4 Claims, 5 Drawing Sheets

LITTER AND REFUSE RETRIEVAL DEVICE

CROSS-REFERENCES TO RELATED APPLICATIONS

This is a continuation-in-part of U.S. design patent application Ser. No. 29/031,375 entitled "Litter Retrieval Device" filed Nov. 23, 1994 by inventor Allen Simon now Design U.S. Pat. No. D368,003.

FIELD OF THE INVENTION

The present invention relates to a litter and refuse retrieval device. In particular, the present invention relates to a hand activated spring biased "pooper scooper."

BACKGROUND OF THE INVENTION

Pet refuse left on a sidewalk or on a street causes sanitary problems, particularly in large urban areas. Many cities have enacted local ordinances requiring that the pet owner clean up after their pets. Such a task is not only unpleasant to perform but may be difficult to perform at the same time as holding a dog by a leash. Therefore, there is a need to provide a device, requiring only single-handed operation, for cleaning up after a pet in a sanitary fashion. Further, since it would be extremely inconvenient to have a device failure in mid-clean up, the device must be strongly constructed, yet must be inexpensive to manufacture.

U.S. Pat. No. 4,248,468 to Hastings discloses one such device. The Hastings patent discloses a litter retrieval apparatus formed of an elongated unitary plastic frame having a handle section at one end, scoop-supporting arms at the other end, and an elongated central section having a passageway for receiving a control rod. The control rod extends through the passageway from the handle to the scoops. Linkages connect the lower end of the control rod to the scoops and spring biasing means are provided for biasing the scoops in a closed position. While most of the device can be cheaply made of molded plastic, the patent discloses that the control rod is made of metal, therefore increasing the cost of such a device. Since the control rod is narrow and extends down the length of the handle, it appears that it must be made of metal or another very strong material.

It is an object of the invention to provide an apparatus for retrieving litter that requires only one-handed operation.

It is another object of the invention to provide an inexpensive apparatus for litter retrieval.

Yet another object of the invention is to provide a strong, reliable device.

A litter and refuse retrieval device is provided for sanitarily and single-handedly cleaning up after a pet. The device includes an outer frame having a handle at one end and outer nipples at the other end for pivotally mounting two scoops. Each scoop includes extended disk portions with holes therethrough that overlap with the disk portions of the other scoop placing the holes in alignment for insertion of the outer nipples of the outer frame. An inner control frame is carried by the outer frame and includes linkage arms having outwardly extending cylindrical portions having nipples extending therefrom for pivotally mounting the two scoops adjacent to the outer nipples. In operation, the inner control frame is squeezed by the user toward a stop potion of the outer frame, causing the scoops to pivot in opposite directions. Also provided is a spring biasing mechanism for closing the scoops after the user has released the inner control frame.

BRIEF DESCRIPTION OF THE DRAWINGS

The foregoing and other features of the present invention will be more readily apparent from the following derailed description of preferred embodiments taken in conjunction with the attached drawings wherein.

DETAILED DESCRIPTION OF PREFERRED EMBODIMENTS

Figure 1:
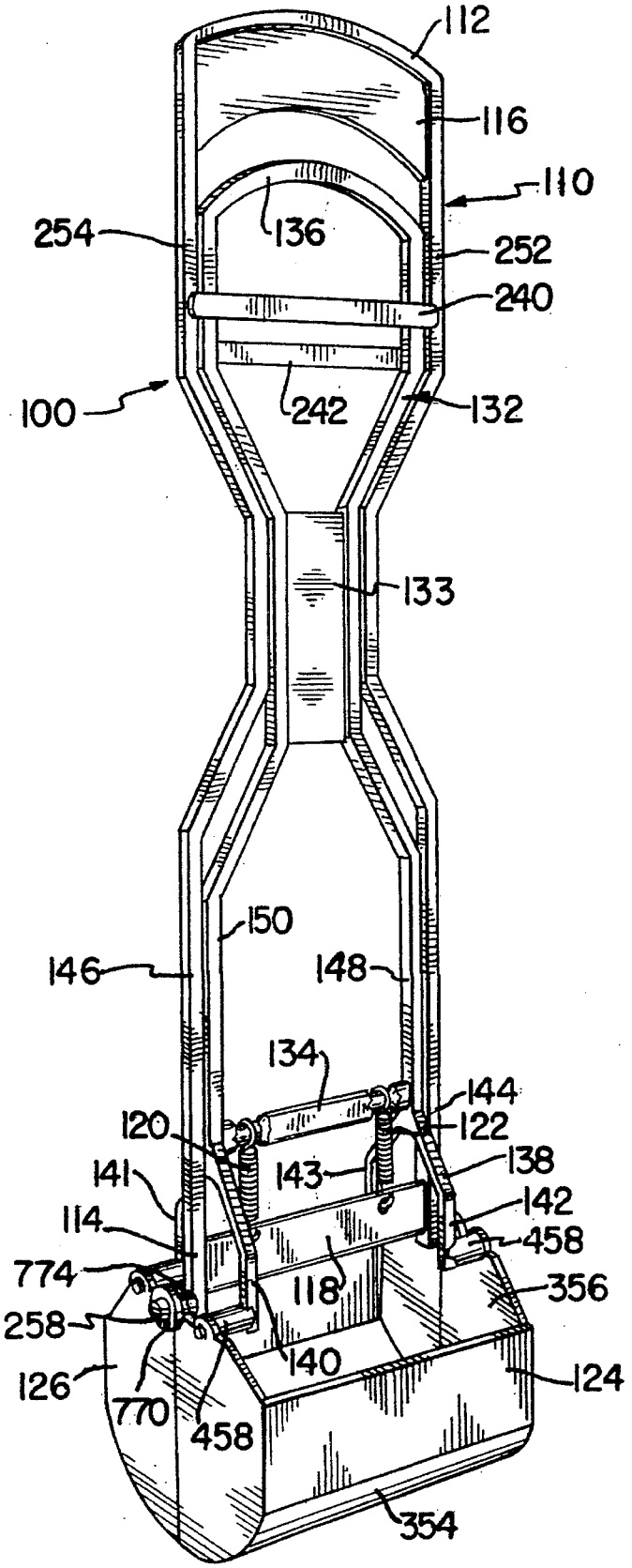
FIG. 1 is a perspective view of the litter retrieval device of the present invention in a closed position.

FIG. 1 is a perspective view of a preferred embodiment of the present invention. Referring to FIG. 1, an elongated outer frame 110 is provided having a handle end 112 and a scoop end 114. Two scoops 124 and 126 are pivotally connected to the scoop end 114 of the outer frame 110 by means of outer nipples 764. The outer frame 110 includes an outer brace 118 extending from a first vertical side 144 to a second vertical side 146 for strengthening its scoop end 114 and for securing the lower end of two biasing springs 120 and 122 thereto.

Carried by the outer frame 110 and aligned therewith is an elongated inner control frame 132 having a handle end 136 and a scoop end 138. The inner frame 132 includes an inner brace 134 extending from a first inner vertical side 148 to a second inner vertical side 150 for strengthening the scoop end 138 and for securing the upper end of the two biasing springs 120 and 122.

A rectangular portion 133 is also preferably provided between the first inner vertical side 148 and the second inner vertical side 150 at the central portion of the inner control frame 132 for providing additional strength to the inner control frame 132.

Included at the scoop end 138 of the inner control frame 132 is a pair of linkage arms 140 and 141 for flexibly and pivotally connecting one side of each scoop 124 and 126 to one side of the inner control frame 132. A second pair of linkage arms 142 and 143 is provided for flexibly and pivotally connecting the other side of each scoop 124 and 126 to the other side of the inner control frame.

The inner control frame 132 can be moved upwardly against the force of biasing springs 120 and 122, until the handle end 136 of the inner control frame 132 meets a stop portion 116 of outer frame 112.

The entire device 100, except for the biasing springs 120 and 122, is preferably made from a hard plastic material with the linkage arms 140, 141, 142, and 143 at least slightly flexible for reasons that will be described later. The device 100 is therefore inexpensive to manufacture, yet strong so that is it not easily broken. Further, the plastic material can be easily cleaned.

Figure 2:
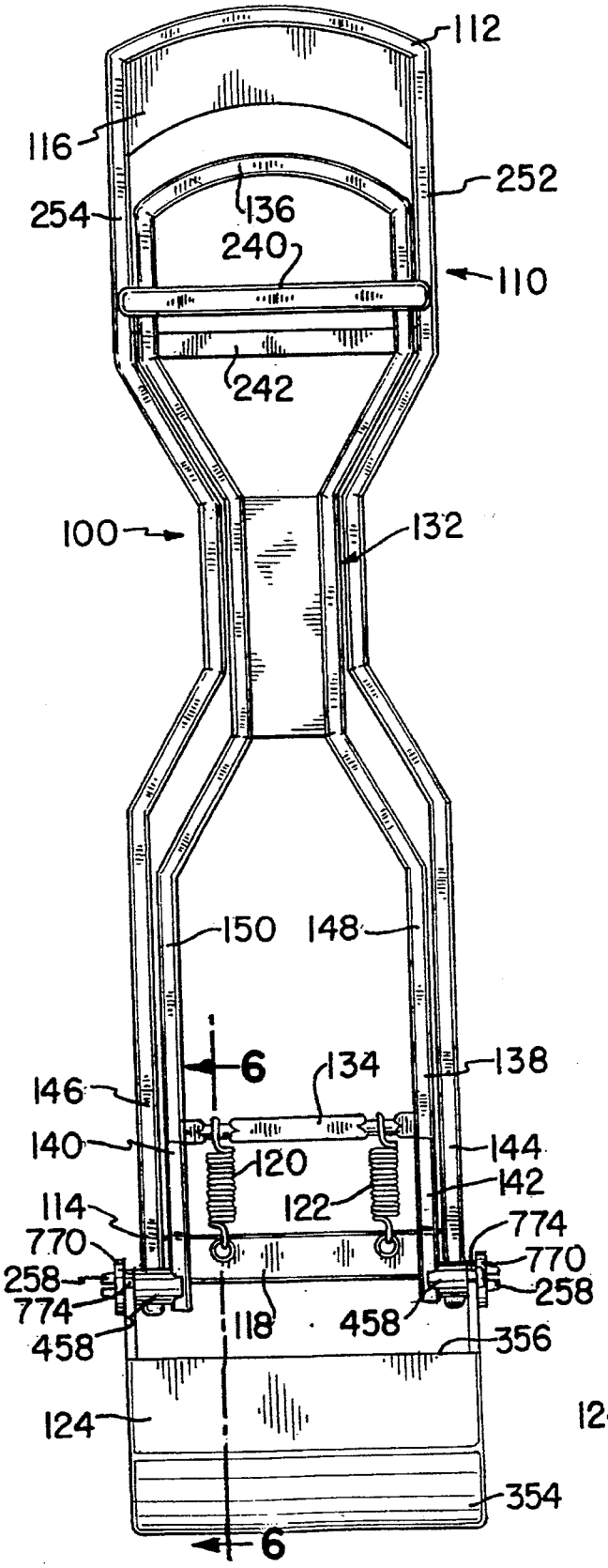
FIG. 2 is a front elevational view thereof.

FIG. 2 illustrates the front elevational view of the preferred embodiment of the present invention. The outer frame 110 is in the form of a flat hour-glass like shape with the inner control frame 132 being similarly shaped but sized to fit within the outer frame 110.

The inner control frame 132 maintains its alignment within the outer frame 110 by means of first and second alignment members 240 and 242 extending between both sides of the outer frame 110. As shown, the first alignment member 240 is attached to the front of two top vertical members 252 and 254 of the outer frame 110, while the second alignment members are similarly attached to the rear.

Figure 3:
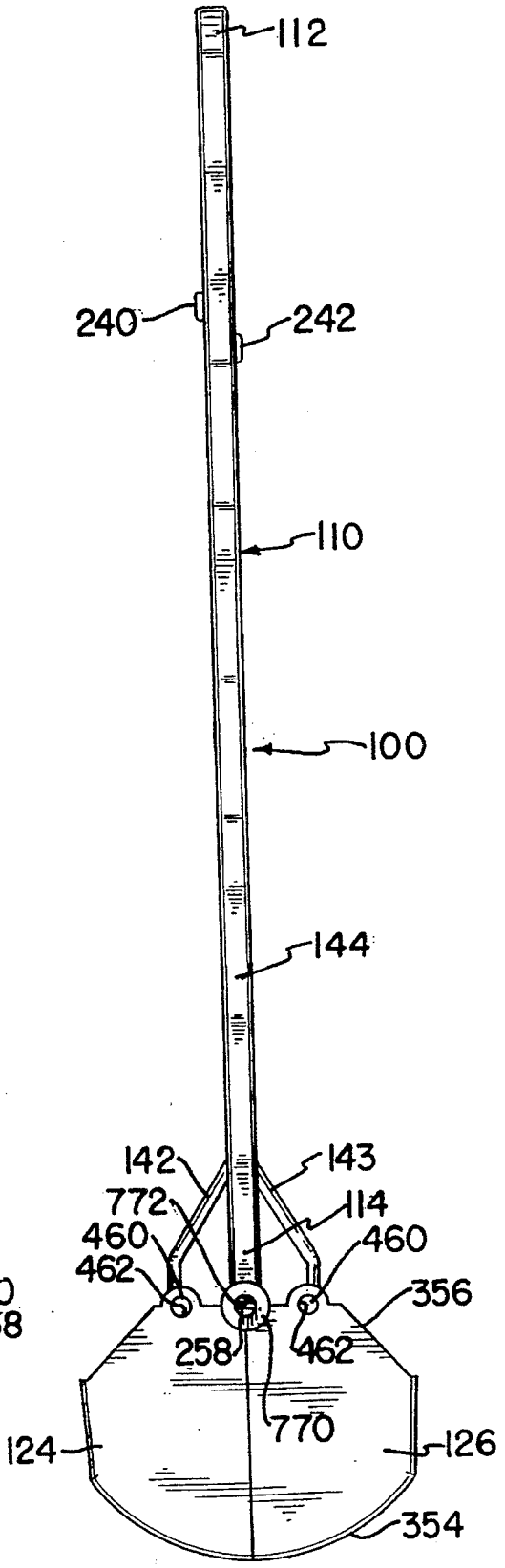
FIG. 3 is a right side elevational view thereof.

FIG. 3 is a right side view of the preferred embodiment of the present invention further illustrating certain of the features of the invention. As described above, the linkage arms 142 and 143 provide connectivity between the inner control frame 132 and the scoops 124 and 126. The linkage arms 142 and 143 outwardly and downwardly extend in an acute angle for a distance from the inner control frame 132, in opposite directions and are preferably integral with the inner control frame 132. The two linkage arms 142 and 143 then extend vertically for a short distance so that each linkage arm 142 and 143 can be pivotally connected to a scoop, linkage arm 142 being connected to the right end of scoop 126 and linkage arm 143 being connected to the right end of the scoop 124. Linkage arms 140 and 141 (shown in FIG. 1) are similarly connected to the left end of scoops 124 and 126 respectively.

The scoops 124 and 126 are formed to mate with each other. As illustrated in FIG. 3 with device 100 in a closed position, the scoops 124 and 126 mate so that they form a container having a closed bottom 354 and an open top 356. The scoops 124 and 126 are connected at central pivot points 258 that also connect both scoops 124 and 126 to the outer frame 110. As will be described in further detail later in connection with FIG. 8, when a user pulls inner control frame 132 upwardly toward the stop portion 116, the linkage arms 142 and 143 cause the scoops 124 and 126 to pivot in opposite directions, opening the bottom portion 354.

Figure 4:
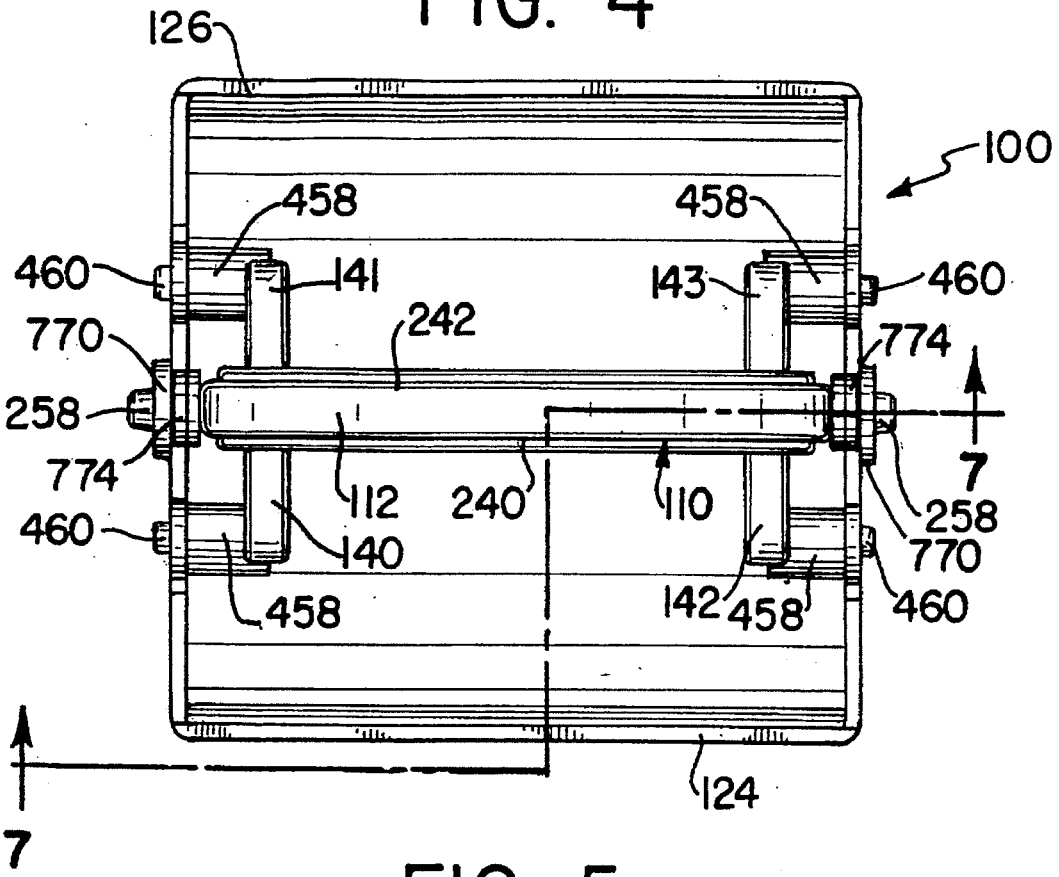
FIG. 4 is a top plan view thereof.

FIG. 4 shows the top view of the present invention in a closed position. As illustrated, the top portion 356 of the container formed by the mating of the two scoops 124 and 126 is open.

Also clearly illustrated is the connection between the linkage arms 140–143 to the scoops 124 and 126. Each of the linkage arms 140–143 include a cylindrical portion 458 having a nipple 460 extending therefrom with the cylindrical portion 458 and nipple 460 extending towards the side of a scoop 124 or 126. Each of the scoops 124 and 126 include a right and left receiving hole 462 and 464, positioned adjacent to the central pivot point 258, dimensioned to receive a nipple 460. The nipples 460 inserted in their respective receiving holes 462 (See FIG. 3) provide the pivotability of the scoops 124 and 124 on the linkage arms 140–143.

Figure 5:
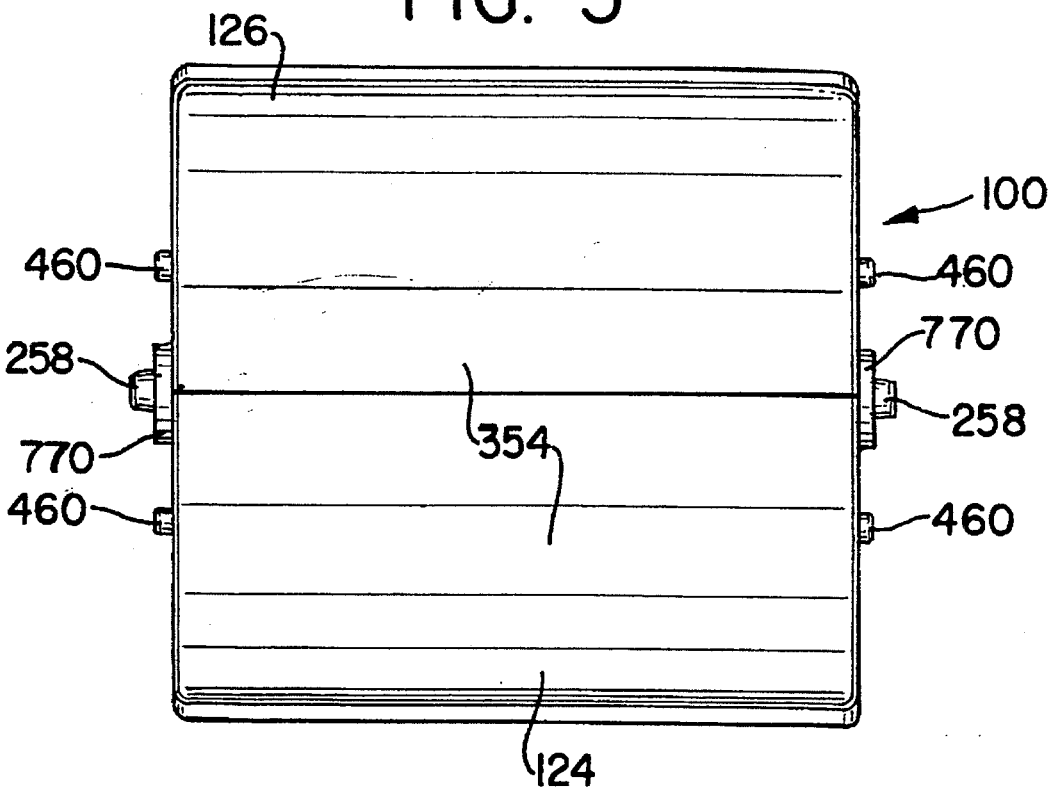
FIG. 5 is a bottom plan view thereof.
Figure 6:
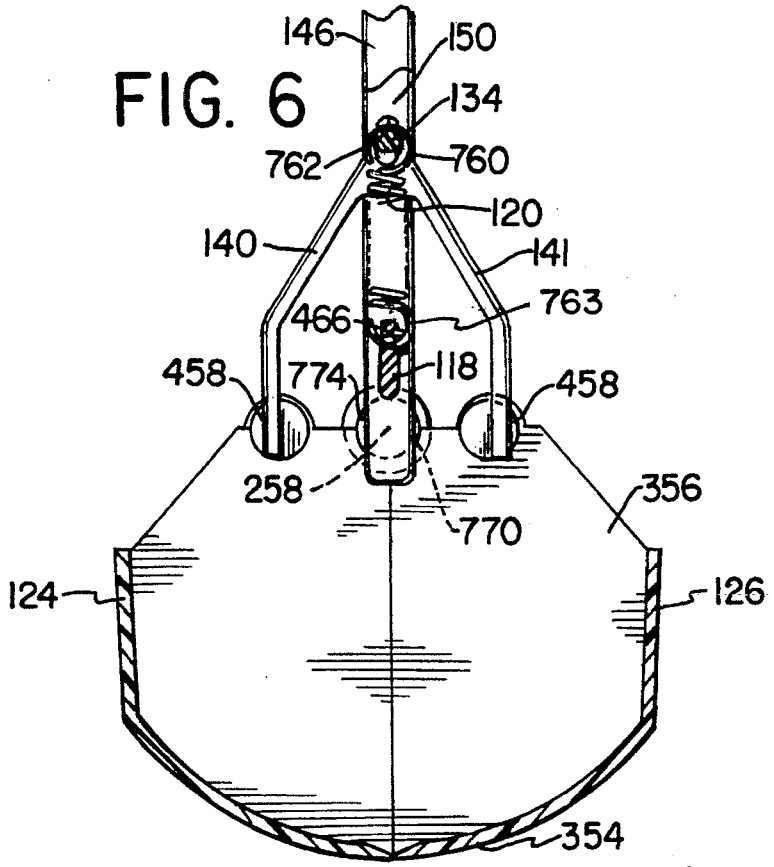
FIG. 6 is a partial sectional view of the scoop portion and spring mechanism of the present invention, taken along lines 6—6 of FIG. 2.

Referring now to FIG. 5, the bottom view of the preferred embodiment in a closed position is shown. The two scoops 124 and 126 mate so as to form a container. The scoops 124 and 126 are tightly mated in the closed position as a result of the biasing springs 120 and 122 as more clearly illustrated in FIG. 6. Referring to FIG. 6, the biasing springs 120 and 122 bias the inner control frame 132 in a down or closed position by pulling the inner brace 134 toward the outer brace 118. In this position, the linkage arms 140–143 push down on the cylindrical portions 458 thus keeping them in alignment with pivot points 258 and tightly mating the scoops 124 and 126. As is evident, the container formed by scoops 124 and 126 in the closed position has a rounded bottom portion 354.

Figure 7:
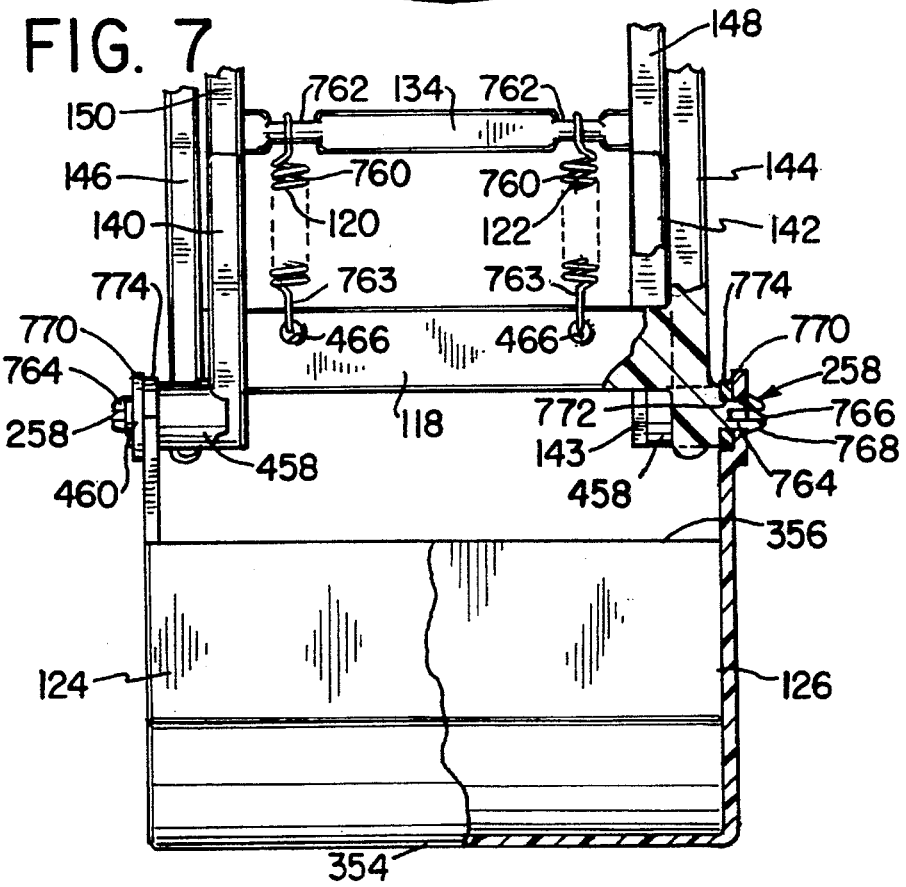
FIG. 7 is a partial sectional view thereof, taken along lines 7—7 of FIG. 4, illustrating the connection between a scoop portion and frames of the present invention.

Referring now to FIG. 7, biasing springs 120 and 122 are secured at the top by looping their respective top loop portions 760 around notched portions 762 of the inner brace 134. Further, the biasing springs 120 and 122 are secured at the bottom by looping their respective bottom loop portions 763 through holes 466 positioned in the outer brace 118. Each hole 466 is positioned adjacent to one of the vertical sides 148 and 150 of the inner control frame 132 and directly below a notched portion 762 so that biasing springs 120 and 122 are substantially parallel to each other and in spaced relationship.

Each of the scoops 126 and 124 include complementary extending disk portions 770 and 774 respectively, each having holes 772 therethrough (more clearly shown in FIG. 1). These disk portions 770 and 774 overlap, and their corresponding holes 772 align when the scoops 124 and 126 are mated. The outer frame 110 is connected to each of the scoops 124 and 126 by means of two outwardly extending outer nipples 764 that are preferably integral with the outer frame 110. The outer nipples 764 have a split portion 766 and shoulder portions 768. Each of the outer nipples 764 are passed through the holes 772 and are secured in place, the shoulder portions 768 extending beyond the holes 772 thus locking the outer nipples 764 in place. The split portion 766 provides flexibility to the outer nipples 764 so that the outer nipples 764 and corresponding shoulder portions 768 are easily passed through the holes 772. Once secured, the scoops 124 and 126 may be pivoted in opposite directions on the outer nipples 764.

Figure 8:
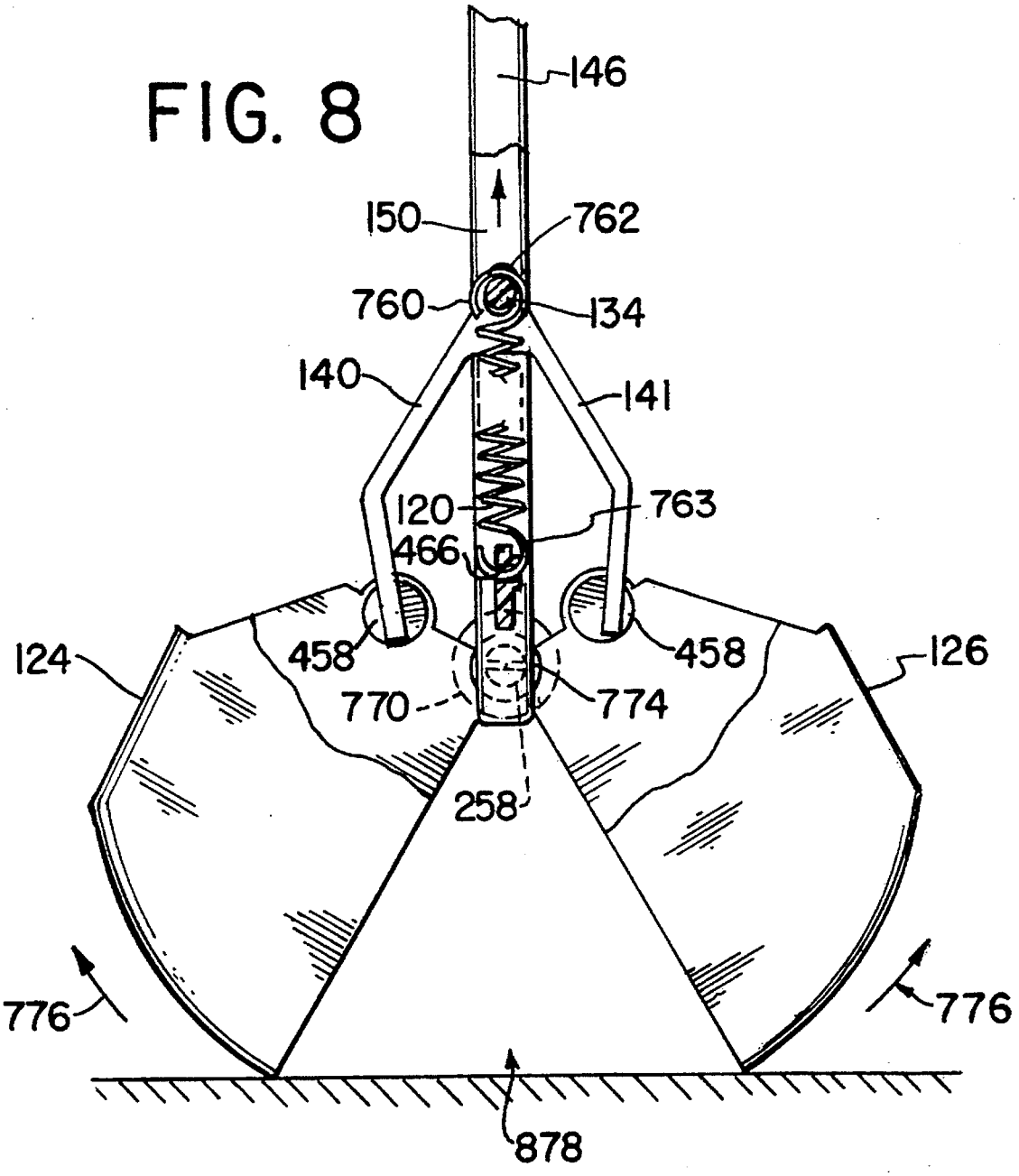
FIG. 8 is a partial sectional view of the scoop portion and spring mechanism similar to FIG. 6 except the invention is shown in an open position.

FIG. 8 illustrates the preferred embodiment of the present invention in an open position. Referring now to both FIG. 8 and FIG. 1, to place the device in this position, a user squeezes the inner control frame 132 with one hand toward the stop portion 116 of the outer frame 110. In doing so, outer frame 110 forces the outer nipples 764 in a downward direction while the inner control frame 132 pulls up on the linkage arms 140–143, causing the scoops 124 and 126 to pivot on the nipples 764 in opposite directions as indicated by the arrows 776. Note that the linkage arms 140–143 flex inwardly as the device is being opened.

When the user releases the inner control frame 132, the biasing springs 120 and 122 pull the outer frame 110 and the inner control frame 132 back to their original positions by means of the inner brace 134 and the outer brace 118.

In operation, the user squeezes the inner control frame 132 in the manner described above. The user then places the now open portion 878 over the refuse to be picked up. The user then releases the inner control frame 132, allowing the scoops 124 and 126 to close, scooping up the refuse in the process.

While the present invention has been particularly shown and described with reference to preferred embodiments thereof, it will be understood by those skilled in the art that various changes in form and details may be made therein without departing from the spirit and scope of the invention.

What is claimed is:

1. A refuse retrieval device comprising:

an elongated outer frame member having a handle at one end and mounting means at another end;

an elongated inner frame member carried by the outer frame member having a handle at one end and two pair of linkage arms at another end, said linkage arms integrally formed with said inner frame member;

a pair of scoop means having a first end and a second end, the first end and the second end being pivotally mounted on the mounting means, each end of the scoop means also pivotally connected to one pair of the linkage arms; and a spring biasing mechanism connected to the inner frame member and the outer frame member for biasing the pair of scoops in a closed position.

2. The refuse retrieval device of claim 1 further comprising:

alignment means connected to the outer frame member for aligning the inner frame member with the outer frame member.

3. The refuse retrieval device of claim 1 wherein the spring biasing mechanism comprises:

a first brace connected between a first and second side of the inner frame member;

a second brace connected between a first and second side of the outer frame member; and a pair of springs connected between the first brace and the second brace one of the springs substantially parallel to the other spring.

4. The refuse retrieval device of claim 1 wherein each of the scoop means has an extended portion at each end, each extended portion having a hole therethrough for mounting on the mounting means, the extended portions of each scoop overlappingly positioned with the extended portions of the other scoop so that the hole in each extended portion at each end of one scoop is in alignment with a corresponding hole in the extended portion at each end of the other scoop.

* * * * *